United States Patent [19]

Kambic

[11] 4,237,711

[45] Dec. 9, 1980

[54] LOCK MECHANISM

[75] Inventor: Raymond V. Kambic, Joliet, Ill.

[73] Assignee: Brink's Locking Systems, Inc., Plainfield, Ill.

[21] Appl. No.: 876,685

[22] Filed: Feb. 10, 1978

[51] Int. Cl.[3] ..... E05B 57/00; E05C 3/16

[52] U.S. Cl. ..... 70/150; 70/432; 292/223

[58] Field of Search ..... 70/145, 151 R, 151 A, 70/150, DIG. 59, 432, 467; 292/169.14, 169.15, 169.16, 167, DIG. 61, 223, 222, 224, 226, 219, 220, 347; 340/644, 542

[56] References Cited

U.S. PATENT DOCUMENTS

| | | | |
|---|---|---|---|
| 563,867 | 7/1896 | Moser | 70/151 R |
| 698,812 | 4/1902 | Carleton | 70/151 R |
| 1,128,392 | 2/1915 | Van Winkle | 70/151 R |
| 1,195,713 | 8/1916 | Page | 70/151 R |
| 1,611,838 | 12/1926 | Malicki | 70/467 |
| 3,390,908 | 7/1968 | Schlage | 292/222 |
| 3,810,145 | 5/1974 | Gusaras | 340/542 |

FOREIGN PATENT DOCUMENTS

| | | | |
|---|---|---|---|
| 480364 | 2/1938 | United Kingdom | 292/347 |

*Primary Examiner*—Kenneth Dorner

*Attorney, Agent, or Firm*—Trexler, Wolters, Bushnell & Fosse, Ltd.

[57] ABSTRACT

There is disclosed a lock mechanism that has been designed to take up a minimum amount of space and thus be accommodatable in a relatively shallow structure. Said lock mechanism includes a pivotally mounted latch bolt, a deadlock member associated with said latch bolt, with biasing means urging said deadlock member to a locking position. To control the operation of the deadlock member there is provided a deadlock trigger and a deadlock position lever providing an operational connection between said trigger and the deadlock member. A primary operating lever as provided comprised of a first pivotally mounted arm portion and a second arm portion integral therewith and connected with the latch bolt by a loss motion connection. The pivot axis for said latch bolt, said primary operating lever and said deadlock member are disposed parallel to and adjacent the front plate of the casing structure, thereby enabling the lock mechanism to be accommodated and to function within a shallow casing structure.

17 Claims, 12 Drawing Figures

LOCK MECHANISM

BACKGROUND OF THE INVENTION

The present invention relates to a lock mechanism designed for mortise mounting in a door frame, stile or jamb, and more particularly to a novel design for a lock mechanism which enables the mechanism to be accommodated in a casing of relatively narrow depth, such that the mechanism can be mortise mounted in modern, narrow door stiles or frames without the need for the provision of special pockets to accommodate the lock casing.

The basic structural elements of the numerous prior art type security locks available do not vary widely, nor does the design of these locks, examples of which are illustrated in U.S. Pat. Nos. 3,999,411; 2,800,347; 2,032,765, and 1,569,228. Basically, all of these prior art designs utilize a retractable latch bolt; one or more separately actuated operating mechanisms, viz. handles, solenoid, or key cylinders, for effecting retraction of the latch bolt; and some form of deadlock mechanism which prevents unauthorized retraction of the latch bolt when the door is in the closed condition. With regard to the latter point, when the door is in the closed or locked condition, retraction of the latch bolt can be accomplished only by way of the provided operating mechanism, with the deadlock mechanism preventing the bolt from being retracted by use of tools or other unauthorized devices.

The prior art designs are such that they require a rather deep casing structure to accommodate the various linkages, levers and operating means which must be housed therein. While these prior art designs have proven satisfactory for conventional door installation, where unlimited depth for mortise of the lock casing is available, the introduction and use by architects of modern door frames and stiles of relatively narrow width has brought to light a severe deficiency in these prior art designs. More specifically, these modern frames or stiles are too narrow to accommodate the deep casing structure or the prior art locks, and if these locks are used, the casings must be modified. As such, a need exists for a lock design that can be accommodated within a narrow or shallow casing structure such that the overall mechanism can be mounted in a narrow stile or door frame without the need for special pockets or modifications. As will become apparent from the discussion to follow with respect to the drawings, the present invention provides a lock construction which fits this need. More specifically, while the lock mechanism of the present invention incorporates the standard structural elements, viz., latch bolt, deadlock and operating mechanism, these elements have been designed and mounted in such a manner that the necessary movement required in the function of the lock is accommodated in a minimum amount of space. Also this design reduces the number of separate components and generally simplifies the overall design, all of which results in a more dependable lock mechanism, without sacrifice of the dependability and strength of the lock. Other advantages and features of the invention will become apparent from the following description of the drawings and discussion of the preferred embodiments of the invention illustrated therein.

BRIEF DESCRIPTION OF THE ILLUSTRATED EMBODIMENT

Referring initially to FIGS. 1–7, the basic construction and mode of operation of a lock mechanism constructed in accordance with the present invention is illustrated. In FIGS. 8–11, there is shown a modified form of operating mechanism that can be used with the basic construction of FIGS. 1–7, as a replacement for the solenoid type operating unit illustrated in said initial figures. Accordingly, attention will be initially directed to FIGS. 1–3 for discussion of the basic construction of the lock mechanism, and then to FIGS. 3–7 with regard to the mode of operation of the lock mechanism.

Figure 1:
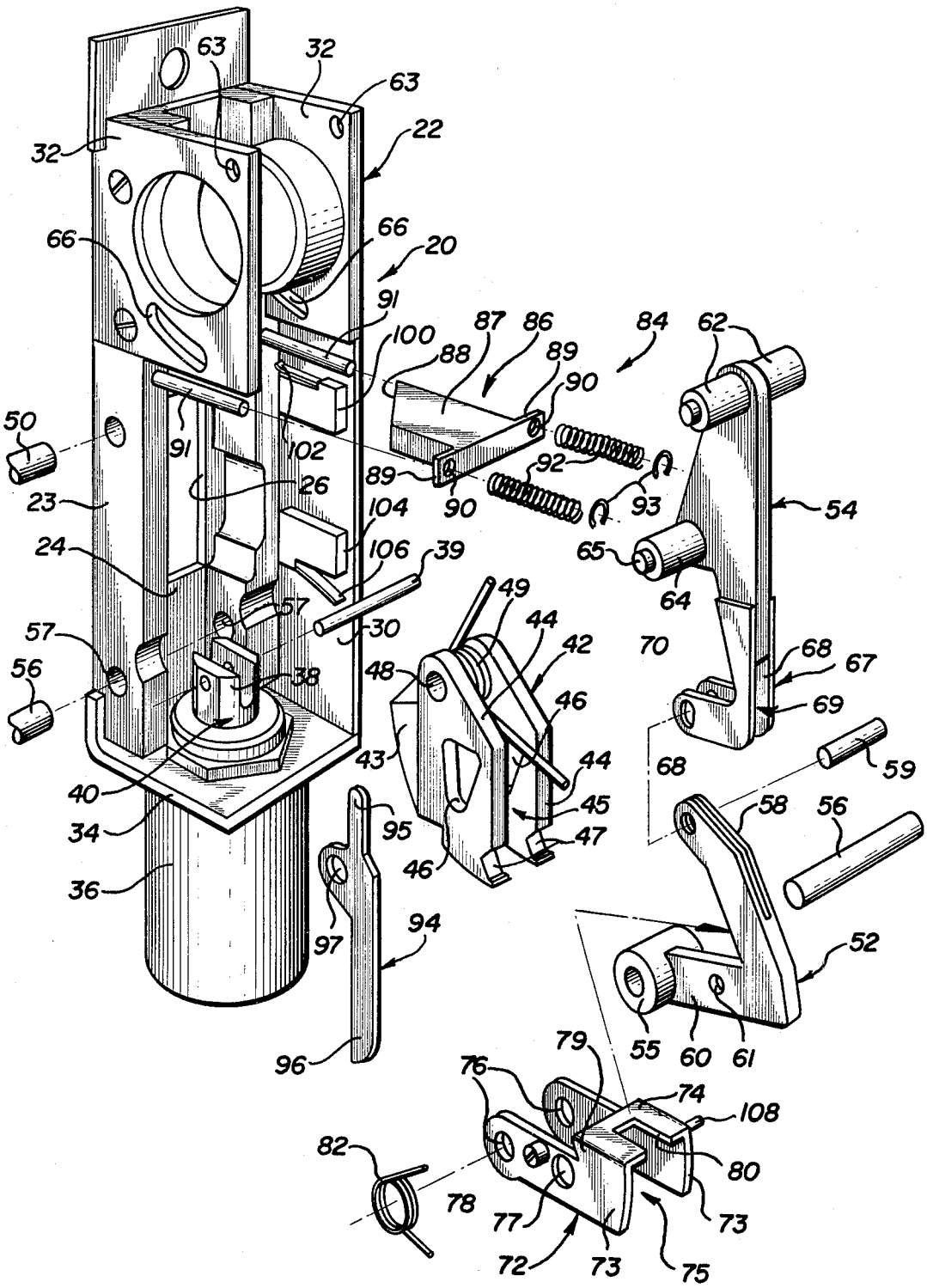
FIG. 1 is an exploded perspective view of a lock mechanism constructed in accordance with the present invention.

The overall lock mechanism is designated generally 20, and will be discussed with reference to FIGS. 1–3 simultaneously. In this regard, FIG. 1 is an exploded view and as such the general shape or construction of the various components can be seen, while FIGS. 2 and 3, on the other hand, illustrate the components in the assembled condition.

Basically, the lock mechanism 20 includes a casing structure designated generally 22, which in the illustrated embodiment is fabricated from a series of separate components, and is adapted for mortise mounting in a door frame, jamb, or stile 21. More specifically, casing 22 includes a base frame 23 to which is attached a face plate 24 provided with a latch bolt aperture 26 and a deadlock trigger aperture 28. Affixed to the sides of the frame 23 in a conventional manner are a pair of side panel assemblies, each designated generally 30, and each including a portion 32 constructed to receive a conventional key cylinder 33 (see FIGS. 2 and 3). At the bottom of the frame 23, as viewed, there is provided an upstanding flange 34 to which is mounted a conventional solenoid 36, with the bifurcated end 38 of its plunger or operating arm 40 disposed interiorly of the casing structure, and including a pin member 39.

The latch bolt of the lock mechanism 20 is best viewed in FIG. 1, and will be discussed initially only with regard to its general construction, with the purpose for the various structural features becoming apparent from the discussion which follows regarding the mounting of the various components and their overall operation. With this in mind, it should be noted that the latch bolt is designated generally 42, and includes an end portion 43 (best seen in FIG. 3), which includes a number of tapered camming surfaces which will cause the bolt to retract upon engagement thereof with a strike plate during closing of the door 31. The opposite surface of the end portion 43 (not visible) is preferably flat. The illustrated design of the end portion 43, while unique, is optional and as is well known in the art, a standard deadbolt type construction could be employed wherein all tapered or camming surfaces are eliminated. In addition to the end portion 43, the latch bolt 42 includes a bifurcated portion which provides a pair of parallel, spaced wall sections 44 which define an interior space 45. Each of the wall portions 44, includes a generally triangular shaped aperture 46 and notched end segments 47, both for a purpose to become apparent hereinafter. In addition, the bolt 44 includes a mounting aperture 48 with a torsion spring 49 disposed generally within the space 45.

Figure 2:
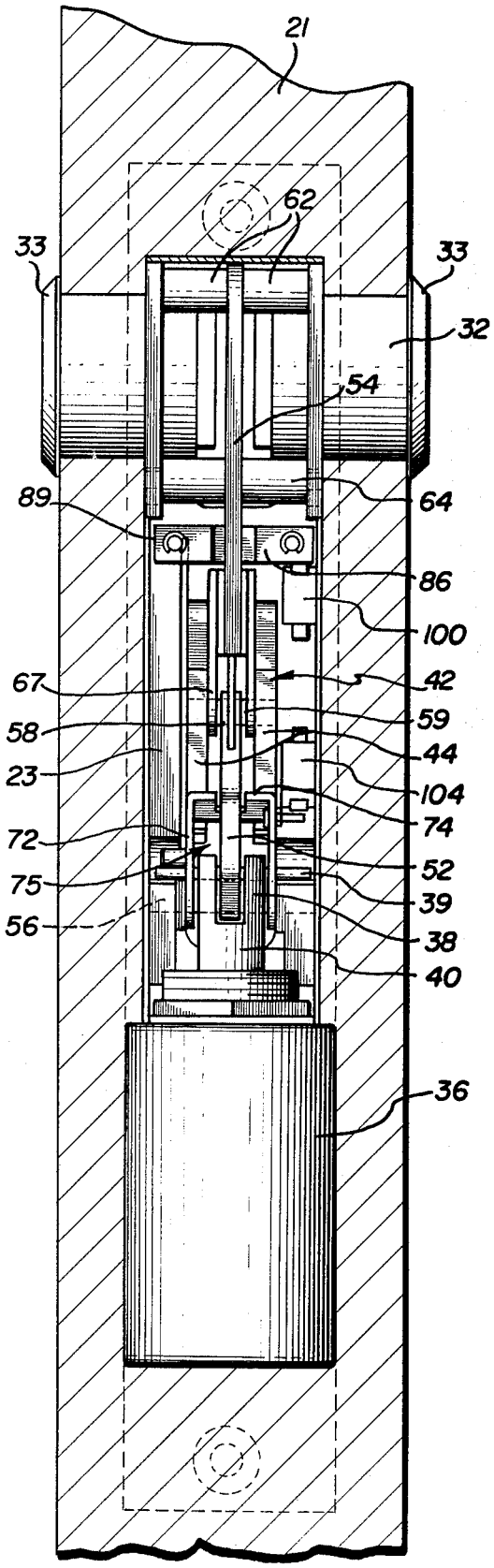
FIG. 2 is a top plan view of the lock mechanism of FIG. 1 mounted in a door frame.
Figure 3:
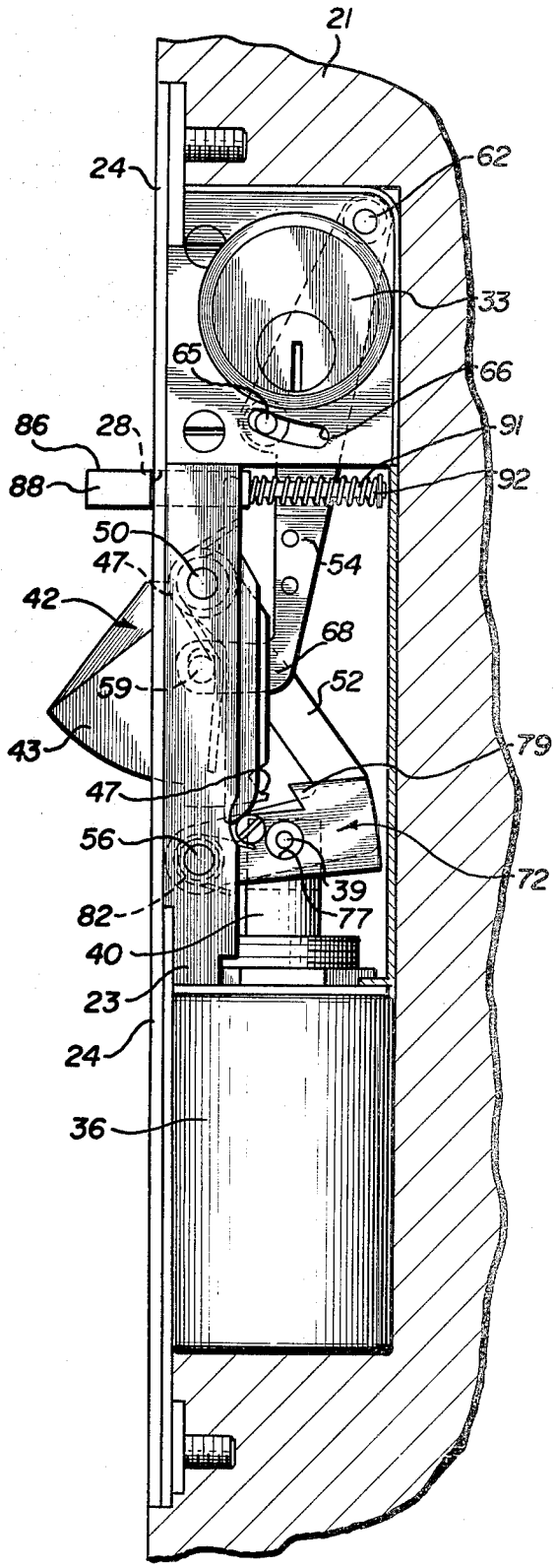
FIG. 3 is a side elevational view of the assembled lock mechanism of FIG. 1, with a portion of the casing removed to illustrate the condition of the various lock components when the door is in the fully opened position.

In the assembled condition of FIGS. 2 and 3, it should be noted that the latch bolt 44 is pivotally mounted to the frame 23 by employment of a pivot pin 50, with the end portion 43 extending from the latch bolt aperture 26, and spring means 49 urging said latch bolt to the extended position.

Operation of the latch bolt 42 from the extended position to the retracted position can be effected by either the solenoid 36 or one or the other of the key cylinders 33. As such, there is provided two separate cam lever means operably connecting the latch bolt to solenoid 36 or key cylinder 33. Lever 52 is the primary operating lever and is connected to the solenoid 36 linking said solenoid to the latch bolt 42, while lever 54 is a secondary operating lever operably associated with the key cylinders 33 and interconnecting these with the latch bolt, as is explained hereinafter.

Attention is first directed to the lever 52 wherein it should be noted that said lever is formed generally in the shape of a bell crank, and includes a mounting boss 55 which receives a pivot pin 56 disposed in apertures 57 in the frame 23, thereby pivotally mounting the lever 52 with respect to said frame. The opposite end of lever 52 includes an apertured end portion 58, which upon assembly, is disposed within the space 45 defined by the separate wall portions 44 of latch bolt 42. To effect attachment of the end portion 58 to the latch bolt 42, the apertured end portion 58 is aligned with the triangular apertures 46 and a pin 59 is engaged therethrough. Lever 52 also includes intermediate portion 60 having an aperture 61, which intermediate portion 60 is received within the bifurcated end 38 of the solenoid operating arm 40, and is affixed thereto by the insertion of the pin 39 through the aperture 61.

The lever 54 is referred to as the key release lever and is also attached to the latch bolt 42 by the pin means 59 and the triangular apertures 46. Before discussing this arrangement, attention is directed to the general construction of the key release lever 54, which includes at the upper end, as viewed, a pair of oppositely disposed mounting pins 62, which are engaged in aperture 63 provided in the casing side portion 32 thus effecting a pivotal mounting of the key release lever 54 to said casing structure. The key release lever 54 also includes a pair of oppositely extending intermediate portions 64, each including guide pins 65 which upon assembly are disposed in arcuate slots 66 formed in the side plates 32. As such, the pivotal movement of the key release lever 54 is restricted by the slots 66. Each of the conventional key cylinders 33 is provided with lug means (not shown), which will engage the guide or intermediate portions 64, to produce the desired pivotal movement of the lever. The opposite or lower end of the lever 54, as viewed, is designated generally 67 and is bifurcated providing a pair of spaced flanges 68 which define a space 69, each of the flanges 68 being apertured at 70.

In the assembled condition, the end portion 58 of the solenoid lever 52 is disposed within the space 69 provided by the bifurcated end 67 of the lever 54, and the respective apertures are aligned. Next, the overlapped end portions are disposed within the space 45 provided by the latch bolt 42, and the pin 59 is engaged through the aligned apertures of the respective end portions 58 and 67, with said pin being disposed within the triangular aperture 46 to effect operative connection of both levers 52 and 54 with the latch bolt 42. For a purpose which will become apparent upon a description of the overall operation of the latch mechanism, it should be noted that the pin 59 is substantially smaller than the triangular aperture 46 which provides what is termed in the art a "lost motion" type of connection. That is to say, due to the extent of the aperture 46, the pin 59 is free to move within said aperture, and initial motion of the respective cam levers will merely take up the play in this connection, with retraction of the latch bolt 42 taking place only after said initial movement.

Attention is now directed to the deadlock mechanism for the lock 20 of the present invention, which due to its unique design contributes to the attainment of a complete locking mechanism which is disposable within a relatively shallow casing. The primary element of the deadlock mechanism is the deadlock member 72, a preferred design of which is shown in FIG. 1. The deadlock 72 is of a generally bifurcated construction, including a pair of spaced wall portions 73 joined together by a bight section 74. Wall section 73 in conjunction with the bight section 74 define a space designated generally 75, and each of said wall sections 73 includes a pair of apertures 76 and 77. The wall section 73 in full view in FIG. 1, is also provided with a cam follower lug 78. It should be noted further, that the respective wall sections 73 also include spaced lip portions 79 to which the bight section 74 is connected, said bight section having a notch 80 formed therein. A torsion spring member 82 is also provided, which upon mounting will have one end thereof in engagement with the lug 78 to bias the deadlock 72 to a blocking position with respect to latch 42.

Concerning assembly of the deadlock 72, attention is directed to FIGS. 2 and 3. In this regard, the apertures 76 in the respective wall sections 73 receive the pin means 56 discussed previously with reference to the pivotal mounting of the lever 52, such that said pin 56 also serves as a pivot for the deadlock 72. The space 75 is sufficiently wide to accommodate the bifurcated end 38 of the solenoid arm 40, which it will be recalled has the intermediate section 60 of the lever 52 disposed therein. As such, in the assembled condition the bifurcated end 38 of the solenoid arm 40, intermediate portion 60 of lever 52, are all disposed within the space 75 provided by the deadlock 72, with the notch 80 accommodating the arm portion of 58 of lever 52. The aperture 61 in intermediate section 60 and the apertures in the bifurcated end 38 are aligned with the apertures 77 provided in the deadlock 72, and the pin 39 is inserted to interconnect the respective components, i.e. operating arm 40, lever 52 and deadlock 72. Of importance for a reason to be discussed more fully hereinafter, is the fact that the aperture 77 is considerably larger than the diameter of the pin 39, such that a limited degree of relative movement between the deadlock 72 and the solenoid arm 40 and lever 52 can take place.

As an additional matter, it should be noted that the torsion spring 82 is disposed about the pin 56 with one arm thereof engaged against lug 78 and the other engaged with the casing 23. As such, and with respect to FIG. 3, the torsion spring 82 will tend to urge the deadlock 72 in the counterclockwise direction, as viewed.

As was alluded to previously, the purpose of the deadlock 72 is to block or prevent unauthorized retraction of the latch bolt 42. In this regard, attention is directed to FIG. 5 momentarily, which illustrates the condition of the lock 20 when the door is in the closed or locked condition. When this occurs, bight 74 and lip portions 79 of the deadlock 72 will overlie the end segments 47 of the latch bolt 42, thus positively blocking or preventing retractive movement thereof. For purposes of convenience and practicality, it is desirable that this blocking function of the deadlock 72 be performed only when the door is in the locked condition. Thus, the deadlock arrangement of the present invention includes components which maintain the deadlock 72 in the retracted or nonblocking condition, as shown in FIG. 3, when the door is in the opened condition. Discussion will now be had with respect to the components which effect this result.

On the side of the latch bolt 42 opposite the deadlock 72, there is provided a deadlock trigger mechanism designated generally 84. The mechanism 84 includes a trigger member 86 having a base portion 87 and a tapered or sloped end face 88. The end of the trigger 86 opposite the sloped end face 88 is provided with a pair of mounting flanges 89 having apertures 90 therein. In the assembled condition, the aperture flanges 89 are engaged over a pair of mounting pins 91 carried by the casing 23. Also engaged over the mounting pins 91 are a pair of compression springs 92 held in mounted relation with respect to the pins 91 by C-clips 93. Accordingly, when assembled the springs 92 tend to urge the trigger 86 to an extended position, as shown in FIG. 3, with the tapered end surface 88 extending from the aperture 28 in face plate 24. The length of the pins 91, and the position of the C-clips 93 thereon are such that the trigger 86 may be retracted substantially entirely within the casing, as will occur upon engagement of the tapered end face 88 with a door frame during closing of the door.

With the above discussion of the deadbolt trigger mechanism 84 in mind, attention is now directed to the structural component which operably interconnects the trigger 86 with the deadlock 72. In this regard, there is provided a deadlock positioning lever 94, best seen in FIG. 1. Lever 94 includes a first end portion 95 and a second end portion 96, with a mounting aperture 97 formed therein intermediate the respective end portions. In FIG. 3, lever 94 is shown in the assembled condition, partially in full line and partially in dotted outline. In this regard, the pivot pin 50, previously discussed with regard to the mounting of the bolt 42 is engaged through the aperture 97 to effect pivotal mounting of the lever 94. In the assembled condition, the first end portion 95 is disposed in the path of movement of one of the mounting flanges 89 on the trigger 86, and the other or second end portion 96 extends past the latch bolt 42 and is disposed for engagement with the lug 78 on the deadlock 72. Accordingly, when the trigger 86 is in the extended position, as shown in FIG. 3, flange 89 will engage the first end portion 95 tending to move the deadlock positioning lever in a counterclockwise direction. This movement raises the second end portion 96 into abutting engagement with the lug 78. It should be recalled that the deadlock 72 is urged in a counterclockwise direction by the spring 82. Such that the engagement of the position lever 94 with lug 78 overcomes the force exerted by the spring 82 and causes the deadlock 72 to move in a counterclockwise direction, to the non-blocking position, as illustrated in FIG. 3.

The lock mechanism 20 illustrated in FIG. 1, may also be provided with lock status sensor switches which can be connected into a monitoring circuit to provide a visual indication as to the condition of the lock. More specifically, there is provided a first sensor switch 100 which includes an operating arm 102 engaged by the trigger 86 such that the switch 100 will indicate whether the trigger 86 is in the extended or retracted condition. Further, there is mounted to the casing 23 a second switch 104, having an operating arm 106 engaged by a pin member 108 carried on the deadlock 72. This switch 104 will thus provide an indication as to whether the deadlock 72 is in the blocking or nonblocking position.

Figure 4:
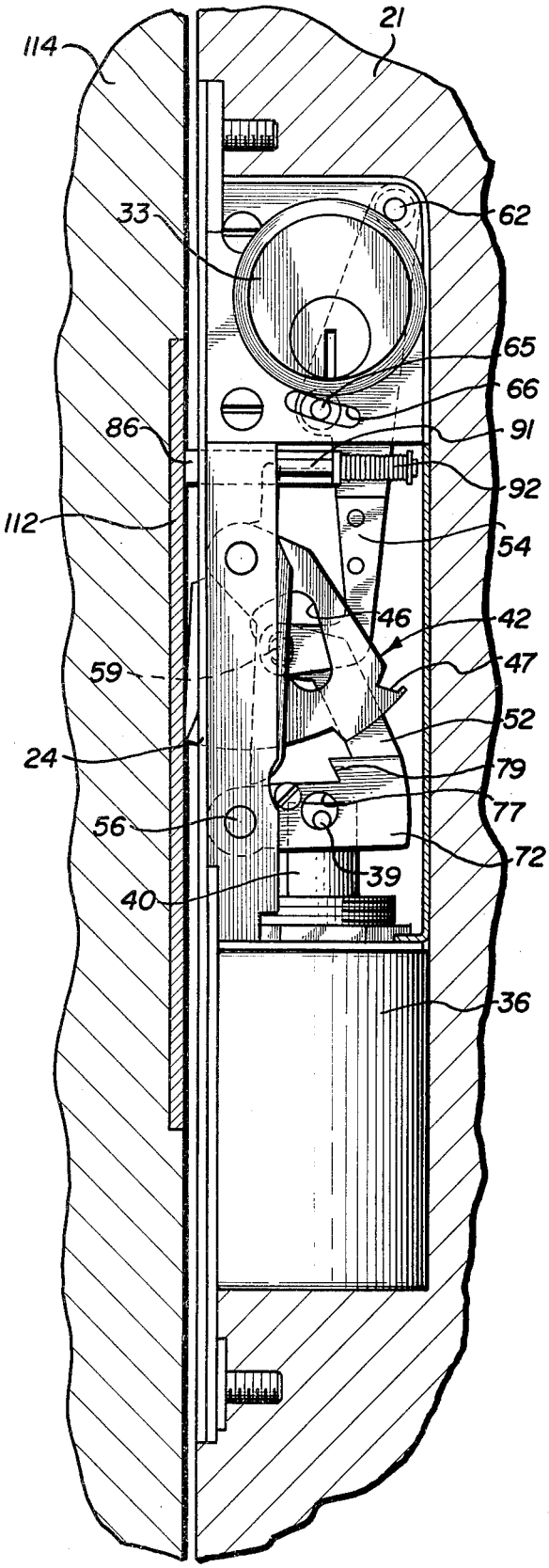
FIG. 4 is a view similar to FIG. 3 while illustrating the condition of the components of the lock mechanism during closing of the door, but before the latch bolt is disposed in the strike aperture.
Figure 5:
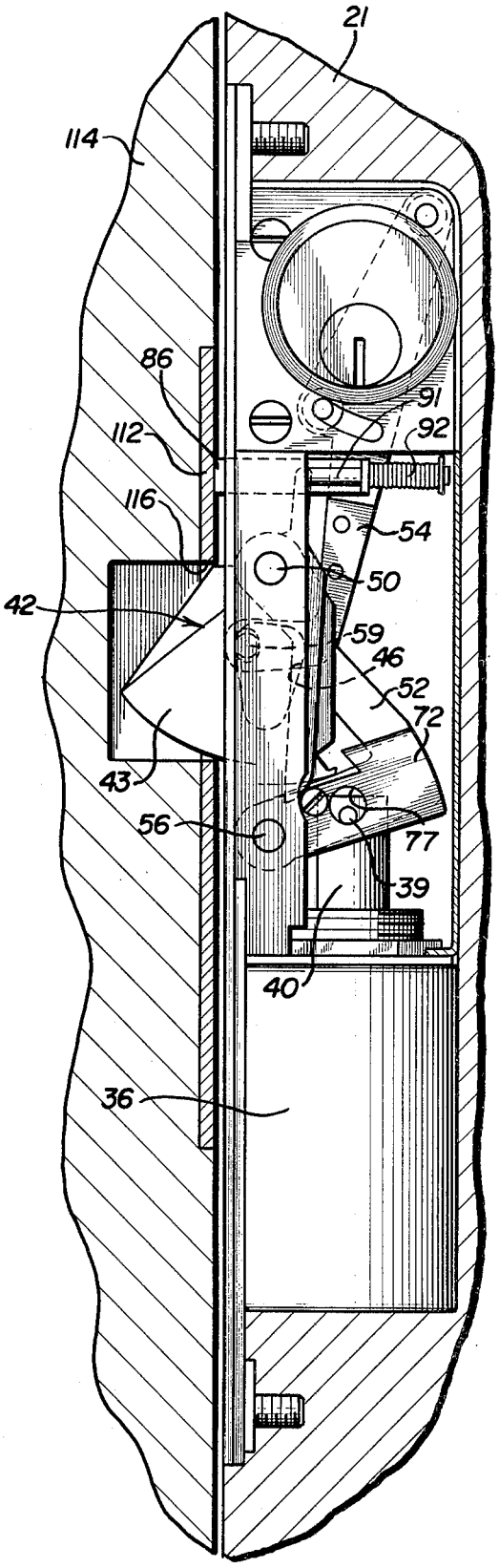
FIG. 5 is a view similar to FIG. 4, but illustrating the condition of the lock mechanism when the door is in the fully closed or locked position.
Figure 6:
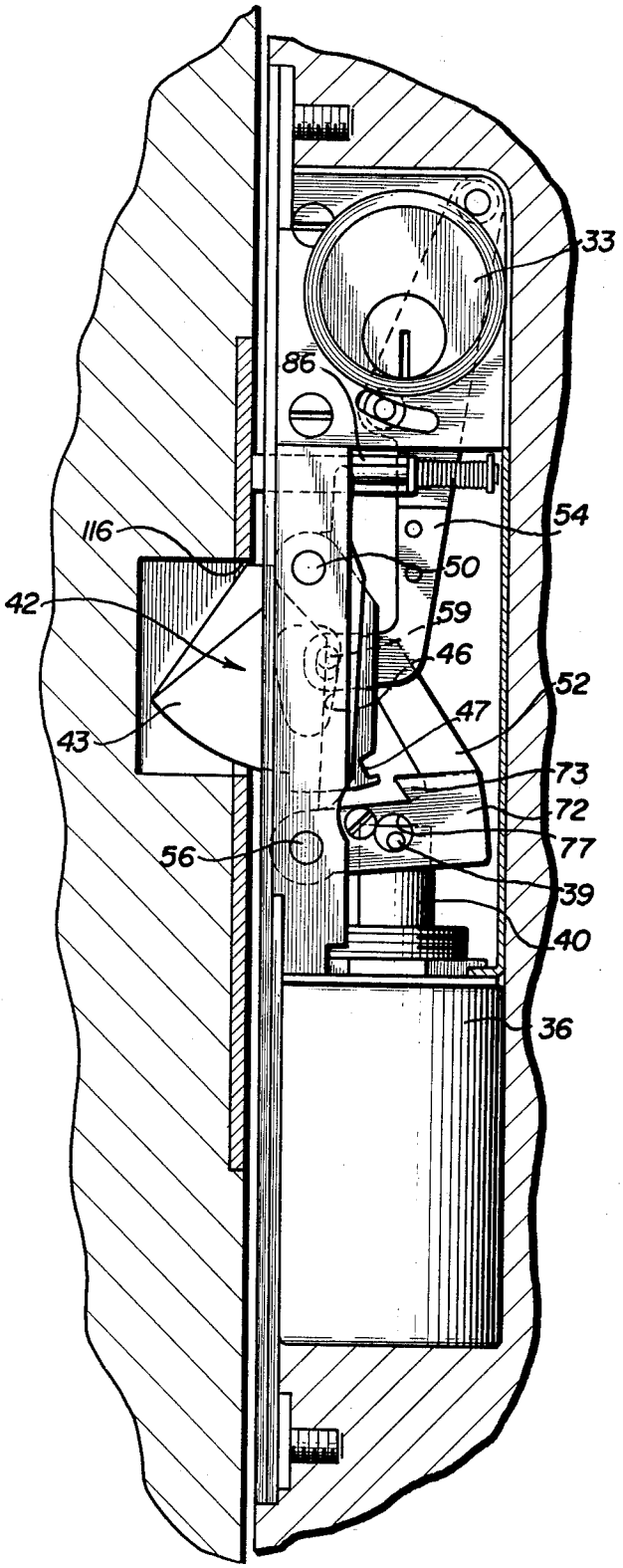
FIG. 6 is a view similar to FIG. 5, but illustrating initial movement of the operating mechanism upon retraction of the solenoid plunger but before the latch bolt commences retractive movement.
Figure 7:
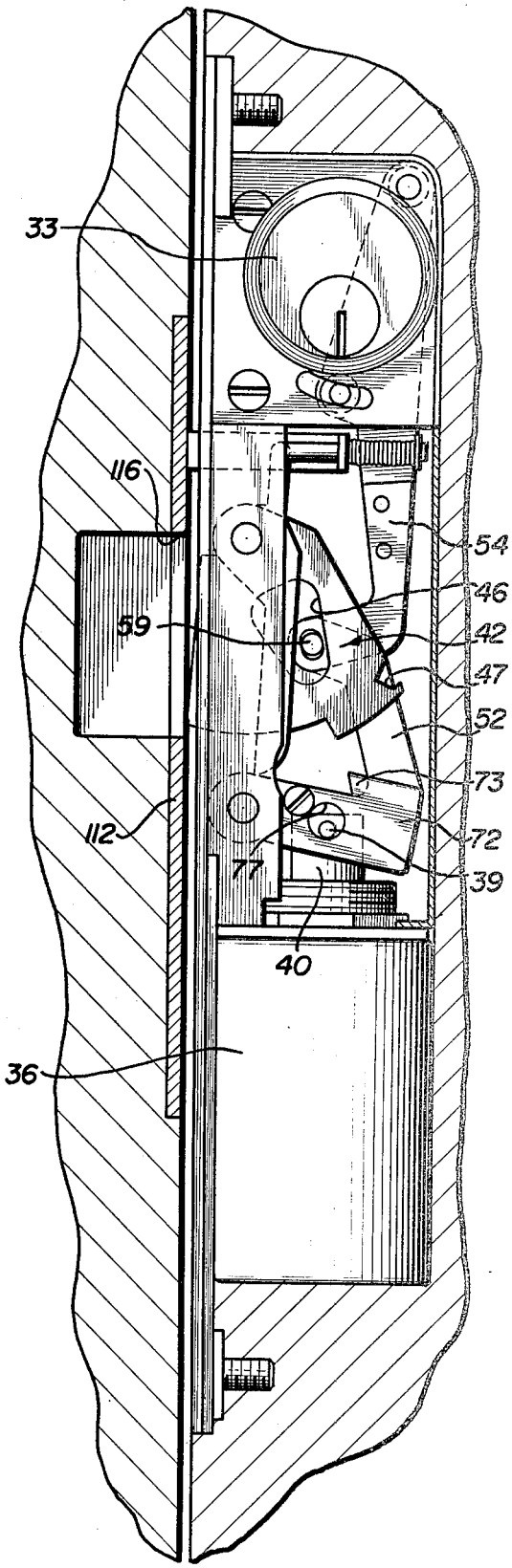
FIG. 7 is a view similar to FIG. 6, illustrating the condition of the components of the lock mechanism when the solenoid plunger is fully retracted and the latch bolt has been withdrawn completely from the strike aperture.

The overall operation of the lock 20 as described above, will now be discussed with regard to FIGS. 3–7. It should be recalled, that FIG. 3 illustrates the condition of the lock when the door is in the fully opened condition; FIG. 4 illustrates the condition of the lock when the door is in the partially closed condition, before disposition of the latch bolt in the strike aperture; and FIG. 5 illustrates the condition of the lock with the door in the fully closed or locked condition. FIG. 6 illustrates the condition of the lock upon initial retractive movement of the solenoid operating arm 40, with FIG. 7 illustrating the condition of the lock components when the solenoid arm 40 is fully retracted and the latch bolt in the recessed position. For purposes of clarity, certain of the structural features such as the various spring means have been eliminated from FIGS. 4–7, in order to facilitate the discussion of the operation of the lock 20.

In the initial or fully opened condition as shown in FIG. 3, the latch bolt 42 and the deadlock trigger 86 will be urged to their extended position with respect to the face plate 24 by the respective spring means 92 and 49. With the deadlock trigger 86 extended, the deadlock position lever 94 is urged in a counterclockwise direction, to bring the second end 96 thereof into engagement with the deadlock lever 72, thereby forcing the deadlock lever 72 in a clockwise direction against the action of the spring 82, moving said deadlock 72 to the non-blocking position with respect to the latch bolt 42.

As the door is closed, the tapered surfaces 88 and 43 on trigger 86 and latch bolt 42, respectively, will engage with the surface 110 of a strike plate 112 mounted to the door frame 114, as is illustrated in FIG. 4. Due to the tapered nature of the surfaces 88 and 43, this engagement produced by the closing action of the door, will cause both the trigger 86 and the latch bolt 42 to be depressed. Since the deadlock 72 is initially in the non-blocking position, the latch bolt is free to move inwardly. As the latch bolt 42 moves inwardly, the lever arms 52 and 54 will be pivoted slightly causing a slight retraction of the solenoid arm 40. It is of importance to note at this point, that depression of the trigger 86 frees the deadlock position lever 94 such that it no longer is urged into engagement with the lug 78 on the deadlock 72, however, since the latch bolt 42 is already slightly depressed, the deadlock cannot move to the blocking position. The abovediscussed movement will continue until the latch bolt 42 is aligned with the strike aperture 116 and a strike plate 112, at which point spring 49 will urge the latch bolt 42 to the extended position disposing the end portion 43 within the strike aperture.

It should be noted, that once the fully closed or locked condition of FIG. 5 is attained, the trigger 86 remains depressed. Accordingly, since no positive engagement of the trigger 86 with the positioning lever 94 exists, the force exerted by the spring 82 (not shown in FIG. 5) will bias the deadlock 72 in a counterclockwise direction, and since latch bolt 42 is now extended, the lip portions 79 of the side plates 73 and the bight 74 will be moved into a position overlying the end segments 47 of the latch bolt 42. As such, the deadlock 72 is now in a blocking position and will prevent any attempt at retraction of the bolt 42 by means other than the solenoid 36 or the key cylinder 33. As can be seen from a comparison of FIGS. 3, 4 and 5, it is necessary that the deadlock 72 be free to move relatively with respect to the lever 52 and the solenoid arm 72.

Attention is now directed to FIGS. 5–7 which illustrate the opening action for the lock mechanism 20. FIG. 6 illustrates the condition of the lock mechanism upon an initial increment of movement, with FIG. 7 illustrating the condition of the mechanism upon completion of the opening action. With regard to the opening action for lock 20, it must be kept in mind that the key actuated operating lever 54 and the solenoid actuated operating lever 52 are linked together for joint movement due to the coupling together of their respective end portions 58 and 67. Thus, operation of either key cylinder 33, or the solenoid 36 will result in pivotal movement of both operating levers 52 and 54. While the following discussion of the opening action illustrated in FIGS. 6 and 7, will be had with regard to the solenoid 36, it is to be understood that this action is essentially the same upon use of either key cylinder 33 to open the lock mechanism.

Before looking to FIGS. 6 and 7, there are several points of importance which should be noted with regard to the position of the lock components as shown in FIG. 5, viz., when the door is closed. As was discussed above, the deadlock 72 is in the blocking position, with trigger 86 depressed and latch bolt 42 extended to dispose the end portion 43 in the strike aperture 116. In addition, please note that the pin 59 which links the operating levers 52 and 54 to each other and to the latch bolt 42 is disposed in the upper left hand portion of the oversized slot 46 (both shown in dotted outline). Also, due to the biasing action of spring 82 on the deadlock 72, the right hand side of the aperture 77 is in engagement with the pin 39 which links the solenoid arm 40 to the lever 52 and the deadlock 72.

With the above in mind, and assuming energizing of the solenoid 36 to commence retractive movement of the arm 40, attention is directed to FIG. 6. Since the deadlock 72 is biased against the pin 39, the initial retractive movement of the solenoid arm 40 will cause the deadlock 72 to pivot in a clockwise direction to a non-blocking position with respect to latch bolt 42. At the same time, retraction of the arm 40 will cause the operating lever 52 to pivot about the pin 56, producing movement of the end portion 58 to the right, as viewed. Since the connection between the lever 54 and the latch bolt 42 is a lost motion type, and the pin 59 is initially disposed in the upper left hand portion of the slot 46, the movement of the pin 59 merely brings said pin into engagement with the upper right hand edges of slot 46, without effecting retractive movement of the latch bolt. Thus, it can be seen that the deadlock 72 is moved to a non-blocking position before any retractive movement of the latch bolt 42 is effected.

With continued reference to FIG. 6, it can be appreciated that the pin 59 is now engaged with the upper right hand portion of the slot 46, and that the deadlock 72 has been retracted to the non-blocking position. Accordingly, continued, retractive movement of the solenoid arm 40 will produce further movement of the pin 59, which, since it is engaged with the upper right hand edges of the slot 46, will produce counterclockwise pivotal movement of the latch bolt 42, retracting the latch bolt end portion 43 from the strike aperture 16 and disposes said end portion 43 inwardly of the casing face plate 24. This condition is illustrated in FIG. 7, and it is believed clear that when the lock 20 is in this condition, the door 21 may be opened.

Once the door 21 is opened, and assuming that the solenoid 36 is de-energized, the structural components of the lock mechanism will return to the condition of FIG. 3 under the influence of the spring mechanisms discussed above. More specifically, springs 92 will bias trigger 86 to the extended condition and spring 49 will urge the latch bolt outwardly of the face plate, with the deadlock position lever 94 being engaged by the trigger flange 89 to cam the deadlock 72 to the non-blocking position.

The above discussion concerning operation of solenoid 36 assures an arrangement that will retract the operating arm 40 in energization of the solenoid coil. This, of course, is but one form available. If a fail safe arrangement is desired, such an arrangement would insure that the lock 20 opens when power is cut off, as might occur with a fire, a different type of solenoid would be used. In this instance, the arm 40 would be extended, as per FIG. 3, when the coil is energized, and an internal spring arrangement used to retract the arm 40 and correspondingly latch bolt 42 when power is interrupted.

From the above, it is believed that the structure and operation of the lock mechanism 20 illustrated in FIGS. 1–7 has been adequately described. It is also believed clear, that the construction of the various lock components and their mode of operation which involves primarily the use of pivotal mounting, is such as to minimize the length of travel required in the movement of these elements, thus permitting the accommodation of the various elements and their movement within a relatively shallow casing. Further in this regard, the various components are created or assembled in a manner which utilizes superposed mounting of one element with respect to the other, thereby conserving space.

In FIGS. 8–12 there is illustrated an alternate form of operating mechanism, designated generally 120, which can be used in place of the solenoid 36 in the lock design 20 discussed above, or said mechanism 120 may be used with locks of differing designs. This alternate operating mechanism 120 is of the handled actuated type, and assuming use with a lock construction such as the lock 20, the mechanism would be coupled directly to the operating lever 52.

Figure 8:
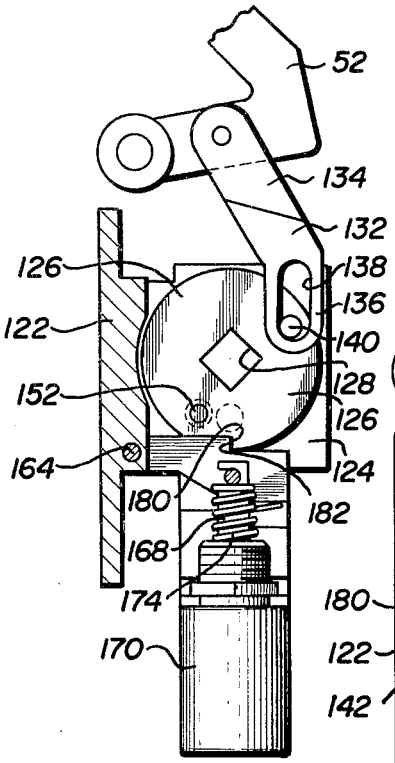
FIG. 8 is a side elevational view of a modified form of an operating mechanism which is actuated by manually operable handles and taken generally along the line 8—8 of FIG. 9.
Figure 9:
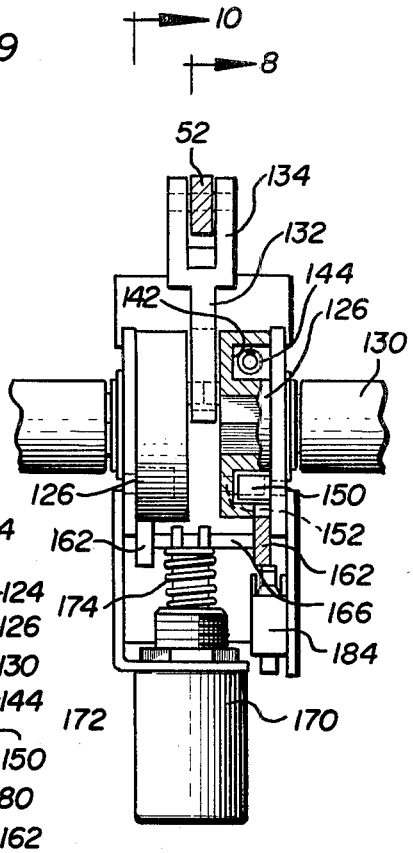
FIG. 9 is a front elevational view of the operating mechanism of FIG. 8.

Looking first to FIGS. 8 and 9, the operating mechanism 120 includes a base or casing element 122, which may be formed integral with or affixed with respect to the overall frame 23 discussed previously. Attached to the casing 122, are a pair of side wall portions 124, each side wall portion 124 having, on the interior surface thereof, a rollback 126 rotatably mounted with respect thereto. Each of the rollbacks 126 is provided with a polygonal shaped central opening 128 for receiving a similar shaped end portion of a handle member 130, which can be used to effect the desired rotation of the rollbacks 126.

The respective rollbacks 126 as assembled are spaced apart slightly, and a link element 132 is disposed therebetween. The link 132 has a first, bifurcated end 134 which is affixed to the operating lever 52, as illustrated, and a second end 136 which is disposed intermediate the rollbacks 126 and includes an elongate slot 138. Each of the respective rollbacks 126 includes a lug or pin 140 on the exposed casing surface thereof opposite the wall portion 24, which pins 140 are engaged in the slot 138. Thus, it will be appreciated that if either rollback 126 is rotated in the clockwise direction, engagement of the pin 140 in the slot 138 will cause the link 132 to retract slightly, resulting in pivotal movement of the operating lever 52 in the same manner previously discussed. Since the slot 138 is elongate, and separate pins 140 are used, the rollbacks 126 can operate independently.

The rollbacks 126 are of a unique, spring biased construction which contribute to the improved operational characteristics of the mchanism 120, and attention will now be directed to this feature. More specifically, each rollback 126 is provided with an annular slot 142, best illustrated in FIGS. 9 and 10, when slot 142 opens toward the wall surface 124. In the assembled condition, the wall surface 124 covers or encloses the slots 142 preventing the entry of dirt, moisture or the like. Disposed within the slot 142 is a compression spring 144 which is formed into a partial circle and includes ends 146 and 148. The wall portion 124 includes a pin member 150 which extends into the slot 142 and engages the end 148 of the compression spring. The rollback 126 includes a similar pin 152 also extending into the slot 142, but from the opposite direction with regard to pin 150, and said pin 152 is engaged with the opposite end of the spring 146 from that engaged by the stationary pin 150.

Figure 12:
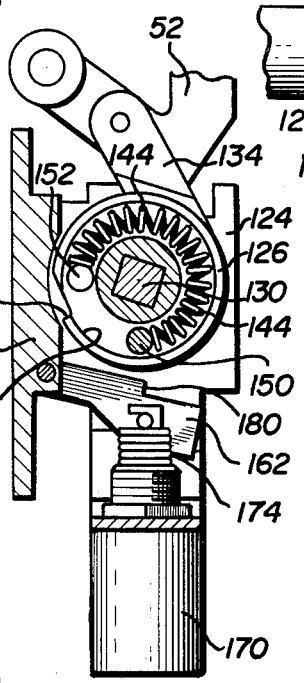
FIG. 12 is a view similar to FIG. 10; with the elements of the modified operating mechanism in the condition achieved upon operation of the mechanism to retract the latch bolt, and with the rollback broken away.

Accordingly, when either rollback 126 is rotated by use of the associated handle 130, the pin 152 carried by said rollback will move with respect to the stationary pin 150 serving to compress the spring 144, as is illustrated in FIG. 12. When the handle 130 is released, the spring 144 will tend to return to its original position and will rotate the rollback 126 in a clockwise direction until the pin 152 abuts the stationary pin 150, thus returning the handle 130 to its initial position.

Locks of the general type discussed are often used in conjunction with exterior building doors and as such it is desirable to control access through these doors. This can be done by selectively rendering the respective active handle and rollback arrangement of mechanism 120 inoperational, such that the handle cannot be turned to effect retraction of the latch bolt. FIGS. 8–12 disclose a preferred arrangement for the selective control of the operability of the handle and rollback mechanisms 120. In the illustrated embodiment, both handles and rollback mechanisms are active, and are subject to being rendered inoperable at the same time. It should be kept in mind that the illustrated embodiment is but one arrangement that can be employed, as the illustrated embodiment can be modified so that only a selected, handle and rollback mechanism is rendered inoperable.

Figure 10:
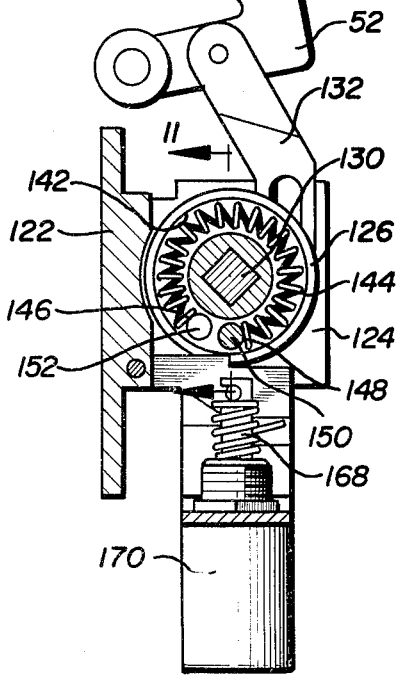
FIG. 10 is a view similar to FIG. 8, but taken along the line 10—10 of FIG. 9.
Figure 11:
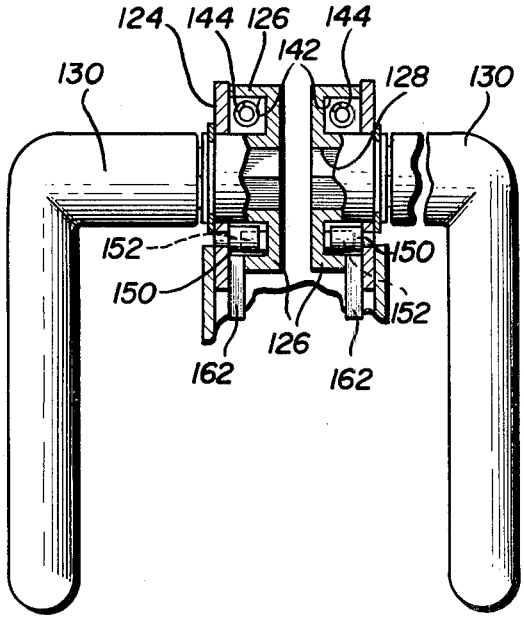
FIG. 11 is a partial sectional view similar to FIG. 9, and taken along the lines 11—11 of FIG. 10.

More specifically, with regard to the control mechanism for the handle and rollback arrangements 120, this mechanism is designated generally 160 and includes a pair of stop members 162 pivotally mounted about a common axis 164. The respective stop members 162 are joined together by a pin 166, which in turn is coupled to the operating arm 168 of a solenoid 170. The solenoid is stationary in that it is mounted to an extension 172 of one of the wall panels 124. A spring member 174 is provided which surrounds the operating arm 116 and tends to bias the stop members 162 and said operating arm to the condition as shown in FIGS. 8–10. Each stop member 162 includes a notch providing an abutment 180, and complimentary thereto, the annular surface portion of the casing for the adjacent rollback 126 is provided with a notch defining an abutment 172.

In the initial condition as shown in FIGS. 8–10, the stop members are positioned such that the respective abutment surfaces 180 and 182 are in engagement. Accordingly, should someone attempt to rotate the door handles 130, the stop members 162 would prevent the rollbacks from rotating in the clockwise direction as required to effect pivotal movement of the operating lever 52 and retraction of the latch bolt. Rotation of the rollbacks 126 in the counterclockwise direction is precluded by the pins 150 and 152, as well as the design of the link 142. When it is desired to permit access, the solenoid 170 is energized and the arm 168 retracted to disengage the stop member 162 from the rollback 126, thereby freeing said rollback for rotative movement. It can be appreciated that the particular rollback to be rendered operable, or inoperable by the mechanism 160 can be selected, and the abutment 180 on the stop member for the opposite rollback eliminated. Since the respective rollbacks 126 are movable independently of each other, the rollback 126 which remains operative can be actuated with the slot 138 permitting the link 142 to move with respect to the pin 140 on the rollback 126 which is maintained in the inoperative mode.

There has been shown and described a preferred embodiment of the basic lock construction of the present invention, as well as a novel handle actuated mechanism which may be used in conjunction therewith. The specific structural elements illustrated and described above contitute preferred forms of the invention and it should be understood that it is not intended that said invention be limited to the specific details of these illustrated embodiments. Applicant is well aware that his invention is capable of modification and variation, and the claims as appended hereto define the spirit and scope of the invention.

The invention is claimed as follows:

1. A lock mechanism including a casing structure adapted to be mounted to a door or door frame and having a front plate with an aperture therein, a latch bolt pivotally mounted with respect to said casing structure adjacent the front plate for movement between a first position wherein a portion thereof extends from the front plate of the casing structure, and a second retracted position, a deadlock member pivotally mounted to said casing adjacent the front plate for movement between a blocking position wherein said deadlock member will prevent retraction of the latch bolt, and a non-blocking position, wherein said latch bolt is free to move to a retracted position, an operating lever having a pivot portion and being pivotally mounted to the casing adjacent the front plate, said operating lever including a first elongate arm portion extending from said pivot portion in a direction away from said front plate, and a second, integral elongate arm portion extending from the free end of said first arm portion toward the face plate, said second elongate arm portion being coupled to said latch bolt by a lost motion type of connection, and selectively operable actuator means interconnected with said operating lever and said deadlock member, with the connection to said operating lever being located intermediate the pivot portion and the free end of said operating lever, said actuator means being capable of effecting pivotal movement of said operating lever and said deadlock member with the initial operation of said actuator means resulting only in the retraction of the deadlock member from the blocking position, with said lost motion connection between said operating lever and said latch bolt delaying movement of said latch bolt until said deadlock member is retracted from the blocking position, said latch bolt, said deadlock member and said operating lever being disposed on pivot axes which extend parallel to and which are in close proximity to said casing front plate, such that the necessary movement of said operating lever, said latch bolt and said deadlock member can be accommodated within a relatively shallow casing structure.

2. A lock mechanism according to claim 1, including a handle-operated mechanism connected to said operating lever means for effecting movement thereof.

3. A lock mechanism according to claim 2, wherein said mechanism includes a pair of handle-actuated, rotatably mounted rollbacks, means interconnecting said rollbacks to said lever means such that operation of one or the other of said rollbacks will produce retraction of said latch bolt.

4. A lock mechanism according to claim 3, wherein each rollback includes an annular channel opening toward and covered by a portion of the casing structure, a compression spring disposed in each said channel, one end of each said spring engaged with stop means carried by the casing structure, and the other end of the spring engaged by an abutment member carried by said rollback, such that rotation of said rollback will effect compression of said spring, with said spring tending to return said rollback to its initial position.

5. A lock mechanism according to claim 1, further including switch means carried by said casing and adapted for use with a monitoring circuit, or the like, to provide an indication of the condition of said lock.

6. A lock mechanism according to claim 5, including a switch positioned to be activated by said trigger to indicate when said trigger is depressed, as in the door closed condition, or extended, as in the door open position.

7. A lock mechanism according to claim 5, including a switch position to be actuated by said deadlock to indicate whether said latch bolt is blocked or unblocked.

8. A lock mechanism according to claim 1, wherein said lost motion connection comprises, a pin member carried by said operating lever means, aperture means provided with respect to said latch bolt having a size greater than the cross-section of said pin member, said pin member being fixedly disposed in said aperture means thereby to interconnect said operating lever means and said latch bolt.

9. A lock mechanism according to claim 1, wherein the means effecting the connection between said deadlock and said operating lever means permits relative movement of the deadlock to the blocking position without movement of the operating lever means from its first position.

10. A lock mechanism including a casing structure adapted to be mounted to a door or door frame and having a front plate with an aperture therein, a latch bolt pivotally mounted with respect to said casing structure for movement between a first position wherein a portion thereof extends from the front plate of the casing structure, and a second retracted position, a deadlock member pivotally mounted to said casing for movement between a blocking position wherein said deadlock member will prevent retraction of the latch bolt, and a non-blocking position, wherein said latch bolt is free to move to a retracted position, an operating lever having a first portion and a second integral portion disposed at an angle with respect to said first portion, said first portion being pivotally mounted with respect to said casing, and said second portion being coupled to said latch bolt by a lost motion type of connection, and said operating lever also being interconnected with said deadlock member, and means for effecting selective pivotal movement of said operating lever to retract said latch bolt, with the initial pivotal movement of said operating lever resulting only in the retraction of the deadlock member from the blocking position, with said lost motion connection delaying movement of said latch bolt until said deadlock member is retracted from the blocking position, said deadlock member and said operating lever being mounted for pivotal movement on a single pivot pin means, with the pivotal axes of said latch bolt, said deadlock member and said operating lever being disposed parallel and in close proximity to said casing front plate, such that the necessary movement of said operating lever, said latch bolt and said deadlock member can be accommodated within a relatively shallow casing structure.

11. A lock mechanism including a casing structure adapted to be mounted to a door or door frame and having a front plate with an aperture therein, a latch bolt pivotally mounted with respect to said casing structure for movement between a first position wherein a portion thereof extends from the front plate of the casing structure, and a second retracted position, a deadlock member pivotally mounted to said casing for movement between a blocking position wherein said deadlock member will prevent retraction of the latch bolt, and a non-blocking position, wherein said latch bolt is free to move to a retracted position, an operating lever having a first portion and a second integral portion disposed at an angle with respect to said first portion, said first portion being pivotally mounted with respect to said casing, and said second portion being coupled to said latch bolt by a lost motion type of connection, and said operating lever also being interconnected with said deadlock member, and means for effecting selective pivotal movement of said operating lever to retract said latch bolt, with the initial pivotal movement of said operating lever resulting only in the retraction of the deadlock member from the blocking position, with said lost motion connection delaying movement of said latch bolt until said deadlock member is retracted from the blocking position, said deadlock member being of a bifurcated construction, and said deadlock member and said operating lever being pivotally mounted on a common pivot, with said operating lever received within said bifurcated portion of said deadlock member with the pivotal axes of said latch bolt, said deadlock member and said operating lever being disposed parallel and in close proximity to said casing front plate, such that the necessary movement of said operating lever, said latch bolt and said deadlock member can be accommodated within a relatively shallow casing structure.

12. A lock mechanism according to any of claims 1, 10 or 11 including a key cylinder operatively connected to a second operating lever means connected with said latch bolt, said lock mechanism being capable of effecting movement of said first mentioned operating lever and said deadlock member through movement of the latch bolt.

13. A lock mechanism according to claim 10 or 11, further including a biased deadlock trigger mounted for movement with respect to said casing structure front plate between an extended position and a retracted position, a separate deadlock position lever pivotally mounted with respect to said casing and including a first end portion operatively associated with said deadlock trigger, and a second end portion operatively associated with said deadlock member, such that when said trigger is in the extended position the deadlock lever is urged to a position whereby said second end portion will effect movement of said deadlock member to the non-blocking position, with movement of the trigger to the retracted position freeing said deadlock member for movement to the blocking position.

14. A lock mechanism according to claim 13, wherein said deadlock includes cam follower means thereon disposed for engagement by the second end portion of said deadlock position lever, such that when said trigger is in the extended position, said second end portion will engage said cam follower means to overcome the force on said deadlock created by said biasing means, thereby to move said deadlock to the non-blocking position with respect to the latch bolt.

15. A lock mechanism according to claim 14, wherein said first end portion of said deadlock lever is positioned to be engaged by said trigger when in the extended position thereby urging said deadlock position lever to cause said second end portion thereof to engage and urge said deadlock to the non-blocking position, with retraction of said trigger freeing said deadlock position lever such that the biasing means for the deadlock will move said deadlock to the blocking position with respect to the latch bolt.

16. A lock mechanism according to claim 13, wherein the axis for pivotal mounting of said deadlock position lever is also disposed in close proximity to said casing front plate.

17. A lock mechanism according to claim 10 or 11, wherein said pivot axes for said latch bolt, said operating lever and said deadlock member are disposed substantially in the same plane.

* * * * *